United States Patent [19]

Friedel

[11] Patent Number: 4,468,802

[45] Date of Patent: Aug. 28, 1984

[54] X-RAY TUBE

[75] Inventor: Rudolf Friedel, Kleinseebach, Fed. Rep. of Germany

[73] Assignee: Siemens Aktiengesellschaft, Berlin & Munich, Fed. Rep. of Germany

[21] Appl. No.: 347,714

[22] Filed: Feb. 10, 1982

[30] Foreign Application Priority Data

Mar. 2, 1981 [DE] Fed. Rep. of Germany ..... 3107949

[51] Int. Cl.[3] ..... H01J 35/00

[52] U.S. Cl. ..... 378/140; 378/125

[58] Field of Search ..... 378/140, 125

[56] References Cited

U.S. PATENT DOCUMENTS 2,952,790 9/1960 Steen ..... 378/140

4,309,637 1/1982 Fetter ..... 378/140

*Primary Examiner*—Craig E. Church

*Attorney, Agent, or Firm*—Hill, Van Santen, Steadman & Simpson

[57] ABSTRACT

In an exemplary embodiment, a metallic shield for the discharge space between the cathode and the anode is connected to a potential which is greater than half the tube voltage and smaller than the entire tube voltage. What is achieved thereby is that backscatter electrons from the focal spot space are withdrawn and the anode load carrying capacity is thereby increased, and that the outside-of-focus component of the radiation is reduced as well. Moreover, a very close-to-focus definition or collimation of the cone of rays is possible. X-ray tubes according to the disclosure are particularly applicable in medical X-ray diagnostics.

5 Claims, 1 Drawing Figure

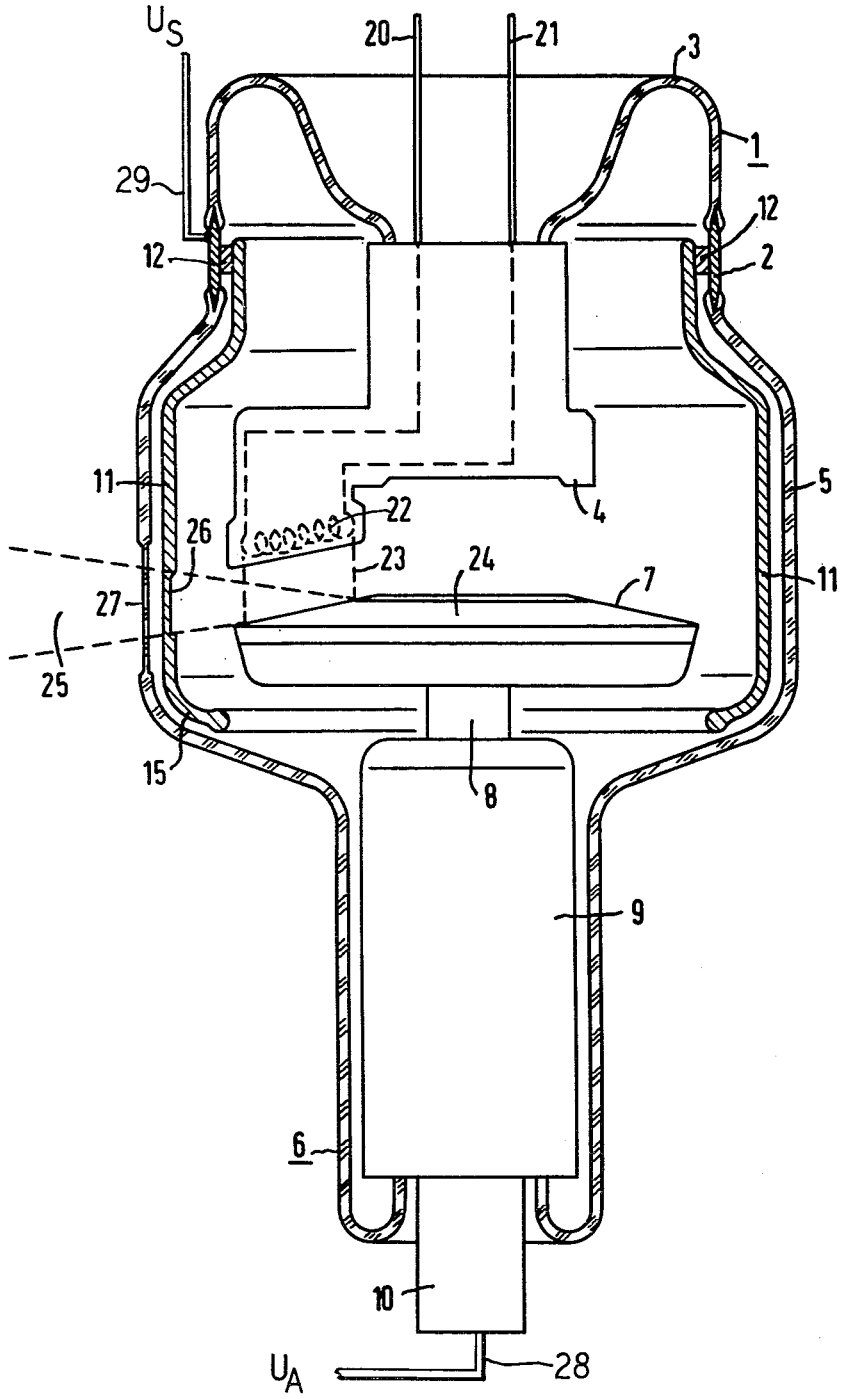
$U_S$
20
21
3
1
29
12
12
2
11
5
22
4
26
23
24
7
11
27
25
15
8
9
6
10
$U_A$
28

X-RAY TUBE

BACKGROUND OF THE INVENTION

The invention relates to an x-ray tube according to the preamble of patent claim 1. X-ray tubes of this type are, for example, known from the publication (page 15) "Concerning The History of Medical X-Ray Tubes" by F. Prellwitz, Medical Technology Department of the Siemens Aktiengesellschaft, Erlangen, Germany, Order No. MR 71/1524, printed in the Federal Republic of Germany SD 06792.5.

In the case of the known tube, the tube housing and the shielding were at the same potential, so that a disruptive discharge through the glass tube envelope was largely prevented. However, an electrode interposed between the focus and the x-ray shield led to an impairment of the attainable X-ray beam. Further, it was disadvantageous here that a difficult and expensive glass technology was necessary, on the one hand, and that, given high tube performances and tube powers conventional today, the shielding, necessarily thermally largely insulated in the case of this method of construction, becomes impermissibly highly heated.

SUMMARY OF THE INVENTION

It is the object of the invention, in the case of an X-ray tube according to the preamble of patent claim 1, in addition to providing an improvement in the dielectric strength and a manufacturing-sympathetic construction, to render possible close-to-focus beam delineation and to obtain an increased anode load carrying capacity. In accordance with the invention, this object is achieved by the measures disclosed in the characterizing clause of claim 1. Advantageous further developments and designs of the invention are the subject of the sub-claims.

Through the utilization of a shield, which is connected to a potential which is greater than half the tube voltage but smaller than the anode potential, in solving the above problem, the result is that a greater portion—in relation to known tubes—of the backscatter electrons is withdrawn from the focal spot, as a consequence of which the anode load carrying capacity increases. Moreover, the fraction of outside-of-focus radiation in the active X-ray beam is decreased. Furthermore, a very close-to-focus delineation or collimation of the cone of rays is possible, because the potential difference between the shield and the anode is less and therefore the distance between the focus and the beam delineating window in the shield can be smaller than in the case of hitherto employed arrangements.

In an advantageous fashion, the inventive shield can be support-mounted on a metal ring which is disposed concentrically to the discharge space. The metal ring can bear, at its one end, an insulating part to which the cathode is mounted, and, at its other end, it can bear an insulating part which bears the anode. In utilizing known advantageous technologies, the insulating parts can consist of glass, so that the conventional glass blowing technique can be employed.

As a rule, the shield receives the shape of a cylinder which encloses the cathode as well as the anode. The thereby resulting, largely metallically limited discharge space prevents the glass wall of the tube envelope from being struck by electrons and metal vapor-depositions.

Moreover, long insulation distances remain which guarantee great dielectric strength.

Further details and advantages of the invention shall be explained on the basis of the exemplary embodiment illustrated on the accompanying drawing sheet; and other objects, features and advantages will be apparent from this detailed disclosure and from the appended claims.

BRIEF DESCRIPTION OF THE DRAWING

The single FIGURE is a somewhat diagrammatic longitudinal sectional view showing a rotary anode x-ray tube constructed in accordance with the present invention.

DETAILED DESCRIPTION

In the exemplary embodiment of the rotary anode X-ray tube 1, illustrated in section 2, designates a metal ring consisting of Vacon which has the shape of an approximately fifteen millimeter (15 mm) long tube piece whose wall is one millimenter (1 mm) thick and which is connected at its one end with a glass part 3 on the interior side of which a cathode arrangement 4 is supported. At its other end, the metal ring 2 bears a glass part 5 which exhibits an anode arrangement 6 at its end. The anode arrangement is comprised of an anode plate 7, a supporting shaft 8, and a rotor 9 for driving shaft 8. A support tube 10 supports rotor 9 and is fixedly mounted on the glass part 5. On the interior side of the ring 2, a shield 11 is mounted which is fixed in the tube 1 via retaining connections 12. As the shield, in the present example, a copper (Cu) plate is employed which is 1.5 mm thick. Also other metal plates, such as e.g. those consisting of nickel or high-grade steel, are suitable for the shield 11 if they are stable given the conditions in the tube.

In order to generate X-rays a filament current is applied between lines 20 and 21 in a manner known per se, which filament current brings the cathode 22 to incandescence. Moreover, via one of the lines 20 and 21 as well as a conductor within support tube 10 connecting with shaft 8, the tube voltage is applied to the tube, so that an electron flow 23 impacts on a focal spot path 24 of the anode plate 7. An X-ray cone 25 is thereby generated which emerges toward the exterior through a window 26 in the shield 11 and the window 27 in the tube envelope. The two windows 26 and 27, in an advantageous manner, consist of beryllium and represent 0.5 mm-thick sheets which are inserted in corresponding openings of the shield 11 and in the wall 5 of the glass tube part, respectively.

It will be apparent that many modifications and variations may be effected without departing from the scope of the novel concepts and teachings of the present invention.

Supplementary Discussion

Referring to the drawing, a conductor 28 is diagrammatically indicated for supplying anode potential $U_A$ to the anode plate 7 via the shaft 8. The cathode conductor 20, for example may be at ground potential (zero volts). For supplying the shield potential $U_S$ as explained herein, a conductor 29 is connected with the shield 11. The potential supplied to the shield 11 may have a value $U_S$ greater than one-half of anode potential, $U_A$, but less than total anode potential; that is $U_A > U_S > U_{A/2}$. For purposes of diagrammatic illustration, conductor 29 is indicated as being electrically connected with the shield 11 via metal ring 2 and metallic retaining connections 12.

In the drawing the shield 11 is shown as comprising a generally cylindrical portion surrounding the anode 7 and cathode 22 and providing x-ray shielding except at the x-ray permeable window 26 which corresponds in size to the desired cone of rays 25. At each axial end of the cylindrical portion of shield 11 there is an integral bounding portion (such as 15 at the anode end) extending in a generally radial direction.

I claim as my invention:

1. An x-ray tube comprising an anode, a cathode arrangement including a cathode, a shield laterally surrounding the discharge space between the anode and cathode, characterized in that the shield is connected to a potential in the range of between half and full anode potential, said shield surrounding said cathode and said anode as well as the discharge space therebetween, and said shield itself having a window for defining a cone of rays to be transmitted from the anode, the potential of the shield while being less than anode potential being greater than half the tube voltage.

2. An x-ray tube according to claim 1, characterized in that the shield encloses the discharge space and in that the shield has bounding parts extending in a generally radial direction.

3. An x-ray tube according to claim 1, further comprising an annular part disposed concentrically to the tube axis, the x-ray shield having support means engaged with said annular part, said annular part being of metal, an insulating part which bears the cathode arrangement being connected with one end of the annular part, and a further part associated with the anode arrangement being connected with the other end of said annular part.

4. An x-ray tube according to claim 3, characterized in that the insulating part and said further part are comprised of glass.

5. An x-ray tube according to claim 3, characterized in that the shield and the annular part are each comprised of metal which is a good thermal conductor.

* * * * *